United States Patent [19]

Amano et al.

[11] Patent Number: 4,891,561

[45] Date of Patent: Jan. 2, 1990

[54] NEON TUBE LIGHTING DEVICE

[75] Inventors: Shintetsu Amano; Yoshinori Mizuhata, both of Gifu, Japan

[73] Assignee: Metalaser Pty. Limited, Pymble, Australia

[21] Appl. No.: 165,958

[22] Filed: Mar. 9, 1988

[30] Foreign Application Priority Data

Nov. 27, 1987 [JP] Japan ..... 62-181376[U]

[51] Int. Cl.[4] ..... H05B 41/36

[52] U.S. Cl. ..... 315/223; 315/219; 315/DIG. 7

[58] Field of Search ..... 315/206, 219, 223, 224, 315/225, DIG. 7

[56] References Cited

U.S. PATENT DOCUMENTS

| | | | |
|---|---|---|---|
| 3,525,900 | 8/1970 | Skirvin et al. | 315/224 X |
| 3,621,331 | 11/1971 | Barron | 315/207 |
| 4,129,805 | 12/1978 | Sherman | 315/219 |
| 4,318,170 | 3/1982 | Cabalfin | 315/219 X |
| 4,331,905 | 5/1982 | Owen | 315/225 |
| 4,348,615 | 9/1982 | Garrison et al. | 315/219 |
| 4,472,661 | 9/1984 | Culver | 315/219 X |
| 4,585,974 | 4/1986 | Stupp et al. | 315/223 X |
| 4,663,570 | 5/1987 | Luchako et al. | 315/219 |

FOREIGN PATENT DOCUMENTS

| | | |
|---|---|---|
| 2934942 | 4/1981 | Fed. Rep. of Germany . |
| WO83/00271 | 1/1983 | PCT Int'l Appl. . |

*Primary Examiner*—David Mis

*Attorney, Agent, or Firm*—Armstrong, Nikaido, Marmelstein, Kubovcik & Murray

[57] ABSTRACT

A neon tube lighting device comprises a resonance circuit, formed by a capacitor and the primary winding of a leakage transformer, which is connected across a DC power supply via a switching element, the ON-OFF operation of which is controlled by the output signal of a signal generator. The output signal provided by the signal generator has a constant frequency substantially equal to the resonance frequency of the resonance circuit. A neon tube is connected to the secondary winding of the leakage transformer.

6 Claims, 2 Drawing Sheets

NEON TUBE LIGHTING DEVICE

BACKGROUND OF THE INVENTION

The present invention relates to a neon tube lighting device which lights a neon tube by means of a high-frequency, high-voltage power supply.

A conventional neon tube lighting device of this kind has a circuit arrangement such as shown in FIG. 1. The AC output of a commercial power source 11 is rectified by a full-wave rectifier 12, the rectified output from which is smoothed by a smoothing circuit 13, the output from which is, in turn, provided to a series circuit of transistors 14 and 15 and a series circuit of capacitors 16 and 17. A primary winding 19 of a transformer 18 is connected between the connection point of the transistors 14 and 15 and the connection point of the capacitors 16 and 17, a neon tube 22 is connected across a secondary winding 21 of the transformer 18, and both ends of a tertiary winding 23 of the transformer 18 are connected to the bases of the transistors 14 and 15, respectively, thus constituting a feedback circuit. The transistors 14 and 15, the capacitors 16 and 17, and the windings 19 and 23 make up a self-excited oscillator. The oscillation frequency of this oscillator is 9.5 kHz, for instance. The magnetic circuit of the transformer 18 constitutes a closed magnetic circuit.

In the conventional neon tube lighting device depicted in FIG. 1, shorting of a load, i.e. the neon tube 22 reduces the impedance of the transformer 18 to zero and an excessive current flows through the transistors 14 and 15, breaking them down. To prevent this, some protective circuit is needed. The total load changes with the length of the neon tube 22 and the number of such tubes connected, and the power source current also changes to vary the brightness of the neon tube 22. With such a load variation, the oscillation frequency of the oscillator is liable to vary since it is a self-excited oscillator. Even if it is provided with a constant-current characteristic by use of a leakage transformer as the transformer 18, the constant-current characteristic itself varies.

Furthermore, the neon tube lighting device shown in FIG. 1 is defective in that the neon lamp lacks stability in discharge. Especially, a decrease in the tube diameter of the lamp and an increase in its current density will both lead to the generation of an irregular discharge and what is called a stripe pattern. When the tube current is 15 mA, a neon tube 15 mm in diameter does not produce the stripe pattern, but a neon tube of a 6 mm diameter produces it; when the tube current is 30 mA, both tubes generate the stripe pattern.

SUMMARY OF THE INVENTION

It is therefore an object of the present invention to provide a neon tube lighting device which is free from the above-said defects of the prior art.

According to the present invention, a resonance circuit is connected across a DC power supply via a switching element, which is placed under ON-OFF control of the output signal from a signal generator. A leakage transformer is employed which uses the winding of the resonance circuit as its primary winding and has its secondary winding connected to a neon tube.

Since the leakage transformer has a constant-current characteristic, a change in the load will not cause a change in the brightness of the neon tube and a short of the load will not cause an increase in the power supply current. In addition, since no self-excited oscillator is employed, the ON-OFF frequency of the switching element is free from the influence of variations in the load, ensuring an excellent constant-current characteristic.

DESCRIPTION OF THE PREFERRED EMBODIMENT

Figure 1:
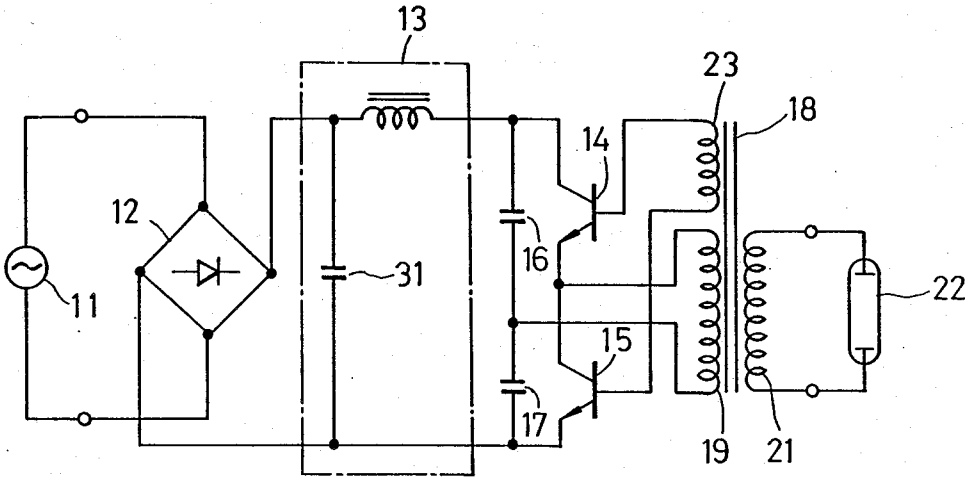
FIG. 1 PRIOR ART
FIG. 1 is a connection diagram showing a conventional neon tube lighting device.
Figure 2:
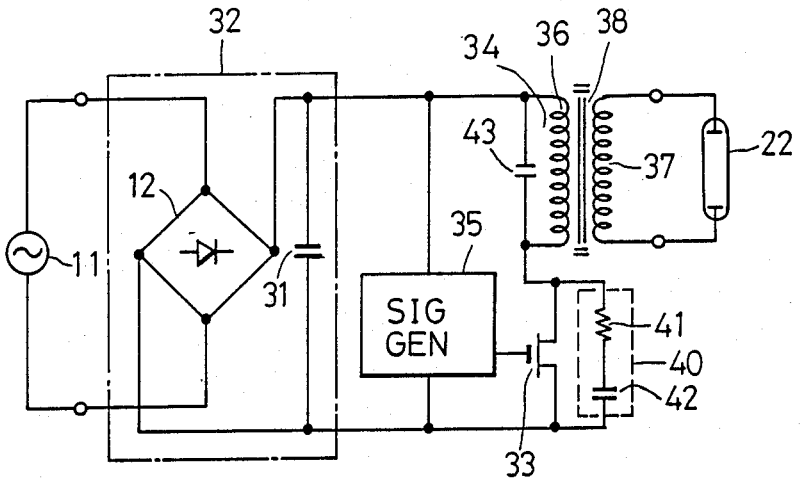
FIG. 2 is a connection diagram illustrating an embodiment of the neon tube lighting device of the present invention.

FIG. 2 illustrates an embodiment of the neon tube lighting device of the present invention. The output of the commercial power supply 11 is applied to the full-wave rectifier 12, the output of which is provided to the capacitor 31. The full-wave rectifier 12 and the capacitor 31 constitute a DC power supply 32. A resonance circuit 34 is connected across the DC power supply 32 via a MOS FET 33 which serves as a switching element. The output signal from a signal generator 35 is applied to the gate of the FET 33 to effect its ON-OFF control. The signal generator 35 creates a rectangular wave signal of a 14 kHz frequency and a 50% duty cycle, for example. The resonance circuit 34 resonates with the output signal frequency of the signal generator 35. A resistor 41 and a capacitor 42 form a protective circuit 40 for the FET 33.

Figure 3:
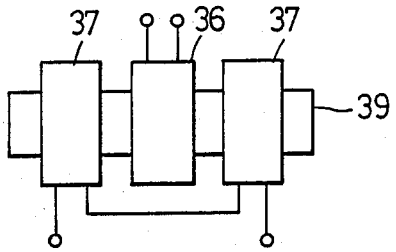
FIG. 3 is a schematic diagram showing a leakage transformer 38 for use in the present invention.

Reference numeral 38 indicates a leakage transformer which uses the winding 36 of the resonance circuit 34 as its primary winding and has its secondary winding 37 connected to the neon tube 22. The magnetic circuit of the leakage transformer 38 is an open circuit. For example, as shown in FIG. 3, the primary winding 36 is wound on a ferrite rod 39 and the secondary winding 37 is wound thereon at either side of the primary winding 36.

The DC voltage of the DC power supply 32 is turned ON and OFF by the ON-OFF operation of the FET 33, by which a high voltage of a high frequency is induced in the secondary winding 37 of the leakage transformer 38, energizing the neon lamp 22 to light.

With the neon tube lighting device of the present invention described above, a constant-current characteristic can be obtained by use of the leakage transformer 38. Consequently, even if the neon tube 22 shows a short, the load current will not increase, causing no excessive current flow in the FET 33. Furthermore, since a constant current flow is generated regardless of a change in the total load with the length of the neon tube 22 or the number of tubes connected in series, the neon tube 22 is lighted with fixed brightness. Moreover, since the ON-OFF operation of the FET 33 is controlled by the output signal of the signal generator 35 and since the signal generator 35 yields a signal of a stable frequency independently of load variations, a more stable constant-current characteristic can be obtained. In other words, the constant-current characteristic of the leakage transformer 38 varies using frequency as a parameter, but since the ON-OFF frequency of the FET 33 is held constant, an excellent constant-current characteristic can be achieved.

Besides, the neon tube lighting device of the present invention enables the neon tube to produce a stable and uniform discharge without generating the so-called stripe pattern. The output of the DC power supply 32 is the full-wave rectified output of a sine-wave voltage. In an experiment conducted on the neon tube lighting device of the present invention in which the peak voltage of the DC power supply was around 140 V, its dip voltage was around 20 V, the output of the signal generator 35 was a rectangular wave having a frequency of 14 kHz and a duty cycle of 50%, the tube current was 15 mA, the capacitance of the capacitor 43 of the resonance circuit 34 was 0.033 $\mu$F, the numbers of turn of the primary and secondary windings 36 and 37 were 165 and 9800, respectively, and the tube diameter of the neon tube 22 was 6 mm, stable lighting of the neon tube was achieved without generating variations in discharge and any stripe pattern.

It will be apparent that many modifications and variations may be effected without departing from the scope of the novel concepts of the present invention.

What is claimed is:

1. A neon tube lighting device comprising:

a leakage transformer having at least a primary winding and a secondary winding;

a resonance capacitor connected across the primary winding of said leakage transformer, said capacitor and primary winding forming a resonance circuit;

a switching element connected in series with said primary winding;

a DC power supply connected across said series connected primary winding and switching element; and a signal generator which generates a signal and supplies the signal to said switching element for effecting ON-OFF control of said switching element, said signal having a constant frequency substantially equal to the resonance frequency of said resonance circuit.

2. The neon tube lighting device of claim 1 wherein said DC power supply comprises the commercial power source, a rectifier for full-wave rectifying the output of the commercial power source, and a capacitor connected to the output of the rectifier.

3. The neon tube lighting device of claim 1 wherein said switching element is an FET.

4. The neon tube lighting device of claim 3, wherein a protective circuit is connected in parallel to the FET.

5. The neon tube lighting device of claim 1, wherein said signal generator is a rectangular wave generator.

6. The neon tube lighting device of claim 2, wherein said signal generator is a rectangular wave generator.

* * * * *

UNITED STATES PATENT AND TRADEMARK OFFICE

CERTIFICATE OF CORRECTION

PATENT NO. : 4,891,561

DATED : January 2, 1990

INVENTOR(S) : Shintetsu Amano and Yoshinori Mizuhata

It is certified that error appears in the above-identified patent and that said Letters Patent is hereby corrected as shown below:

In the Heading, Item [73] should read:

Kabushiki Kaisha Sanyo Denki Seisakusho, Gifu, Japan

Signed and Sealed this

Fifteenth Day of January, 1991

*Attest:*

HARRY F. MANBECK, JR.

*Attesting Officer*

*Commissioner of Patents and Trademarks*